US010807367B2

(12) United States Patent
Miyagawa et al.

(10) Patent No.: US 10,807,367 B2
(45) Date of Patent: Oct. 20, 2020

(54) LIQUID DISCHARGE DEVICE AND LIQUID DISCHARGE APPARATUS INCLUDING LIQUID DISCHARGE DEVICE

(71) Applicants: Hiroaki Miyagawa, Kanagawa (JP); Yuichiro Maeyama, Kanagawa (JP)

(72) Inventors: Hiroaki Miyagawa, Kanagawa (JP); Yuichiro Maeyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/296,630

(22) Filed: Mar. 8, 2019

(65) Prior Publication Data

US 2019/0283415 A1 Sep. 19, 2019

(30) Foreign Application Priority Data

Mar. 16, 2018 (JP) ..... 2018-049867
Feb. 20, 2019 (JP) ..... 2019-028396

(51) Int. Cl.

*B41J 2/145* (2006.01)
*B41J 29/02* (2006.01)
*B41J 2/165* (2006.01)
*B41J 25/304* (2006.01)

(52) U.S. Cl.

CPC ..... *B41J 2/145* (2013.01); *B41J 2/16585* (2013.01); *B41J 25/304* (2013.01); *B41J 29/02* (2013.01)

(58) Field of Classification Search

CPC ..... B41J 25/308; B41J 25/304
See application file for complete search history.

(56) References Cited

U.S. PATENT DOCUMENTS 4,841,306 A * 6/1989 Archer ..... B41J 2/2103 347/4
6,419,334 B1 * 7/2002 Akuzawa ..... B41J 25/006 347/37
7,784,891 B2 * 8/2010 Kumagai ..... G03G 21/168 347/104

(Continued)

FOREIGN PATENT DOCUMENTS

JP 2008-279695 11/2008
JP 2009-045905 3/2009

(Continued)

*Primary Examiner* — Shelby L Fidler
(74) *Attorney, Agent, or Firm* — Harness, Dickey & Pierce, P.L.C.

(57) ABSTRACT

A liquid discharge device includes a head array, a support body, a moving assembly, and a head array fixing device. The head array fixing device fixes the head array at an approach position. The head array fixing device includes a gripping target member and a gripping member. The gripping target member is disposed on one of the head array and the support body and extending in a direction in which the head array approaches or retracts from a recording region of a recording medium. The gripping member is disposed on another of the head array and the support body, to grip the gripping target member to position the gripping target member in a conveyance direction and a width direction of the recording member. A gripping position at which the gripping member grips the gripping target member is adjustable in at least one of the conveyance direction and the width direction.

14 Claims, 8 Drawing Sheets

(56) References Cited

U.S. PATENT DOCUMENTS

| | | | | |
|---|---|---|---|---|
| 8,506,047 | B2 * | 8/2013 | Wachter | B41J 2/155 347/42 |
| 2009/0051724 | A1 | 2/2009 | Katoh | |
| 2010/0066781 | A1 | 3/2010 | Niihara et al. | |
| 2010/0236047 | A1 * | 9/2010 | Tsai | B41J 25/308 29/464 |
| 2011/0063644 | A1 | 3/2011 | Niihara et al. | |
| 2011/0064497 | A1 | 3/2011 | Niihara et al. | |
| 2011/0229242 | A1 | 9/2011 | Morinaga et al. | |
| 2012/0075382 | A1 * | 3/2012 | Kachi | B41J 25/006 347/37 |
| 2012/0133704 | A1 * | 5/2012 | Profaca | B41J 2/155 347/24 |
| 2012/0139987 | A1 | 6/2012 | Maeyama et al. | |
| 2012/0140010 | A1 | 6/2012 | Ogawa et al. | |
| 2012/0140011 | A1 | 6/2012 | Yamada et al. | |
| 2012/0210838 | A1 | 8/2012 | Maeyama et al. | |
| 2012/0222530 | A1 | 9/2012 | Yoshinuma et al. | |
| 2013/0095990 | A1 | 4/2013 | Maeyama et al. | |
| 2013/0195536 | A1 | 8/2013 | Yoshinuma et al. | |
| 2013/0240593 | A1 | 9/2013 | Maeyama | |
| 2014/0146106 | A1 | 5/2014 | Maeyama | |

FOREIGN PATENT DOCUMENTS

| | | |
|---|---|---|
| JP | 2012-071473 | 4/2012 |
| JP | 2012-187713 | 10/2012 |

* cited by examiner

LIQUID DISCHARGE DEVICE AND LIQUID DISCHARGE APPARATUS INCLUDING LIQUID DISCHARGE DEVICE

CROSS-REFERENCE TO RELATED APPLICATIONS

This patent application is based on and claims priority pursuant to 35 U.S.C. § 119(a) to Japanese Patent Application Nos. 2018-049867, filed on Mar. 16, 2018, and 2019-028396, filed on Feb. 20, 2019, in the Japan Patent Office, the entire disclosure of each of which is incorporated by reference herein.

BACKGROUND

Technical Field

Aspects of the present disclosure relate to a liquid discharge device and a liquid discharge apparatus including the liquid discharge device.

Related Art

In an image forming apparatus such as a printer and a facsimile machine in which an inkjet system is adopted, the landing accuracy of ink droplets on a recording medium is important in order to achieve higher image quality of an output image. Accordingly, there is a known technique to suppress variation in relative positions between a recording medium on which ink droplets land and a head array having a plurality of liquid discharge heads including nozzles to discharge ink droplets.

SUMMARY

In an aspect of the present disclosure, there is provided a liquid discharge device that includes a head array, a support body, a moving assembly, and a head array fixing device. On the head array, a plurality of liquid discharge heads to discharge liquid is arranged in a width direction orthogonal to a conveyance direction of a recording medium. The moving assembly moves the head array to an approach position at which the head array is approached to a recording region of the recording medium and a retract position at which the head array is retracted from the recording region. The head array fixing device fixes the head array at the approach position. The head array fixing device includes a gripping target member and a gripping member. The gripping target member is disposed on one of the head array and the support body and extending in a direction in which the head array approaches or retracts from the recording region of the recording medium. The gripping member is disposed on another of the head array and the support body, to grip the gripping target member to position the gripping target member in the conveyance direction and the width direction. A gripping position at which the gripping member grips the gripping target member is adjustable in at least one of the conveyance direction and the width direction.

In another aspect of the present disclosure, there is provided a liquid discharge apparatus that includes the liquid discharge device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
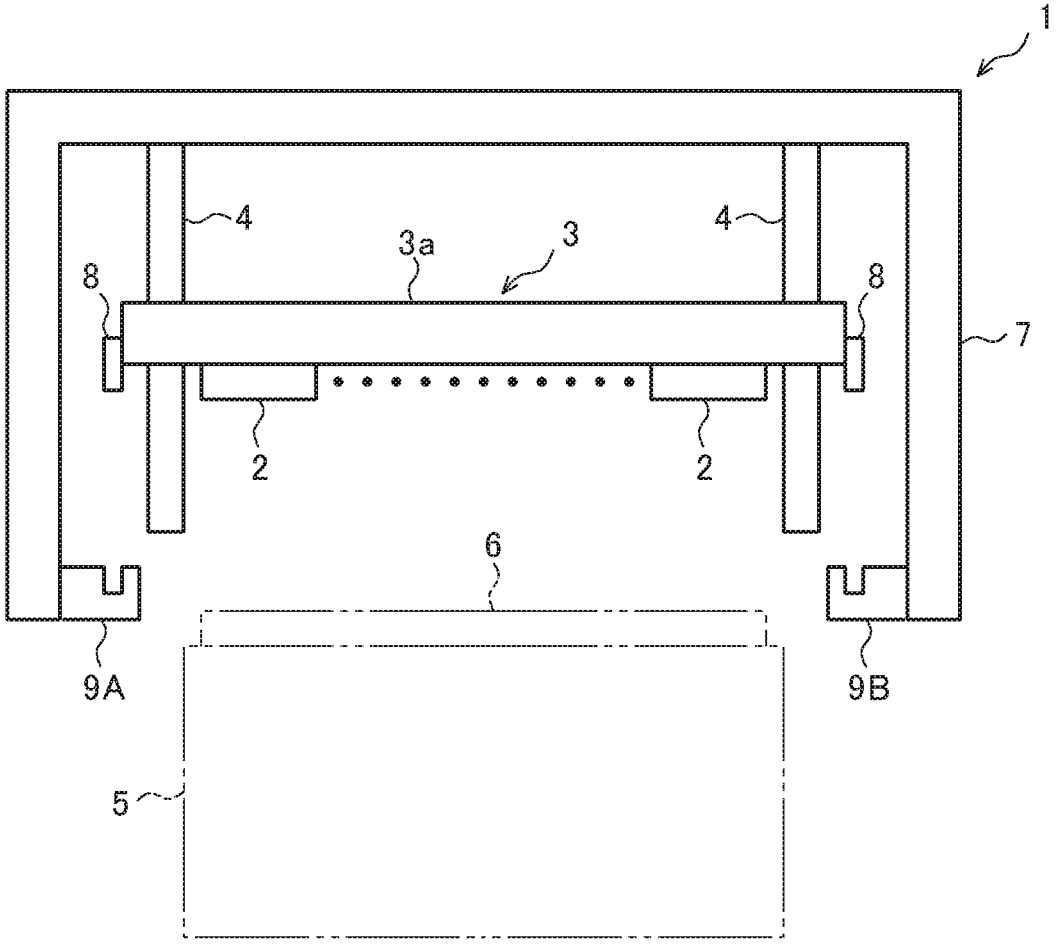
FIG. 1 is a schematic structural diagram of a liquid discharge device according to an embodiment of the present disclosure during retraction of a head array.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 illustrates a liquid discharge device 1 according to an embodiment of the present disclosure. In FIG. 1, the liquid discharge device 1 includes a plurality of recording heads 2 as liquid discharge heads. The plurality of recording heads 2 is alternately arranged in a zigzag manner in a head array body 3*a* for manufacturing reasons such as a yield rate and a processing limit, and constitutes the head array 3 so that an arbitrary recording region is formed.

The recording head 2 approaches the recording region where a recording medium passes through so that a discharged droplet lands with high accuracy, whereas the recording head 2 retracts from the recording region in order to perform maintaining and recovering operation such as capping and wiping to maintain and recover liquid discharge ability. The liquid discharge device 1 moves the head array 3 in a vertical direction in FIG. 1 by a moving assembly 4 to perform the above-described approach/retraction operation. The liquid discharge device 1 is held in a state illustrated in FIG. 1 during retraction from the recording region and is held in a state illustrated in FIG. 2 during approach to the recording region.

Figure 2:
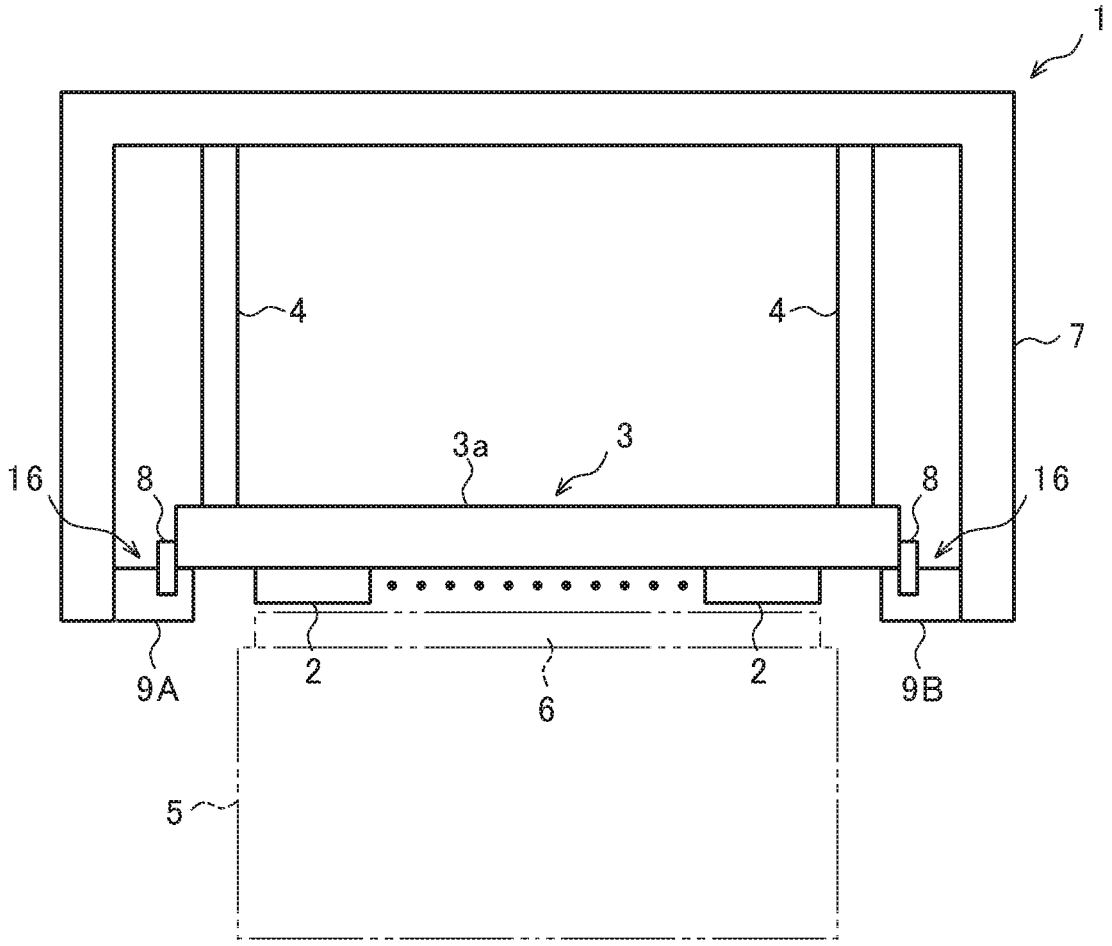
FIG. 2 is a schematic structural diagram of the liquid discharge device of FIG. 1 during approach of the liquid discharge device to the head array.

The moving assembly 4 as an approach-and-retraction device that makes the head array 3 approach and retract from the recording region has a structure that allows a ball screw or the like to perform reciprocating motion in one direction. With operation of the moving assembly 4, the head array 3 performs approach/retraction operation with respect to the recording region of a transfer sheet 6 that is the recording medium passing above a conveyance device 5 included in a liquid discharge apparatus. In FIGS. 1 and 2, a sheet plane direction (a sheet leading side and a sheet tail side) is a conveyance direction of the transfer sheet 6, and a lateral direction is a width direction. The moving assembly 4 is fixed so as not to be moved relative to a support frame 7 as a support body of the liquid discharge device 1. Note that a rigid body may be interposed between the support frame 7 and the moving assembly 4.

During the approach illustrated in FIG. 2, the transfer sheet 6 is conveyed by the conveyance device 5 and passes through the vicinity below the head array 3, but at this point, vibration occurs along with conveyance operation of the conveyance device 5. On the other hand, a weight of the head array 3 is not negligible in terms of this structure. Therefore, when the head array 3 is moved up and down during the recovery operation and recording operation, there is a disadvantage that relative positions between the head array 3 and the transfer sheet 6 are deviated and recording accuracy is deteriorated. The present embodiment can prevent occurrence of such a disadvantage.

As illustrated in FIGS. 1 and 2, positioning pins 8 functioning as gripping target members are attached to both side surfaces of the head array body 3*a* respectively, and the positioning pins 8 are formed in a manner extending in an approach-and-retraction direction of the head array 3, namely, the vertical direction in FIGS. 1 and 2. Each of the positioning pins 8 has a columnar shape and is fixed to the head array body 3*a* by a method such as welding, adhesion, or screwing. FIGS. 1 and 2 each illustrate the structure in which the positioning pins 8 are directly fixed to the head array body 3*a*, but the positioning pins 8 may also be fixed via holding members such as brackets.

Figure 3:
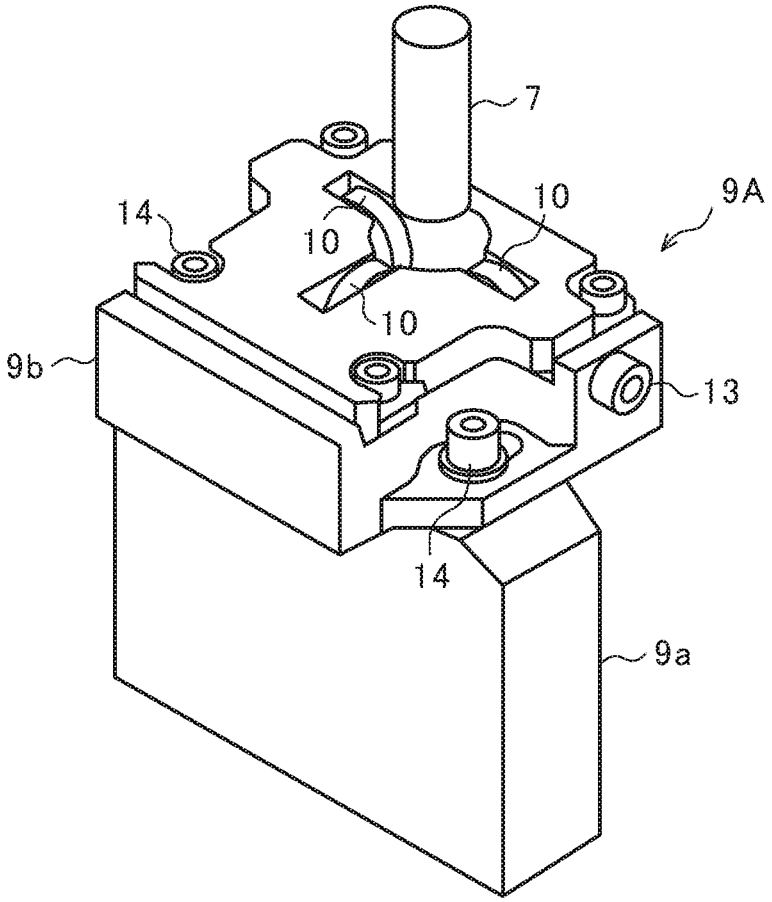
FIG. 3 is a schematic perspective view of a gripping member according to an embodiment of the present disclosure.
Figure 4A:
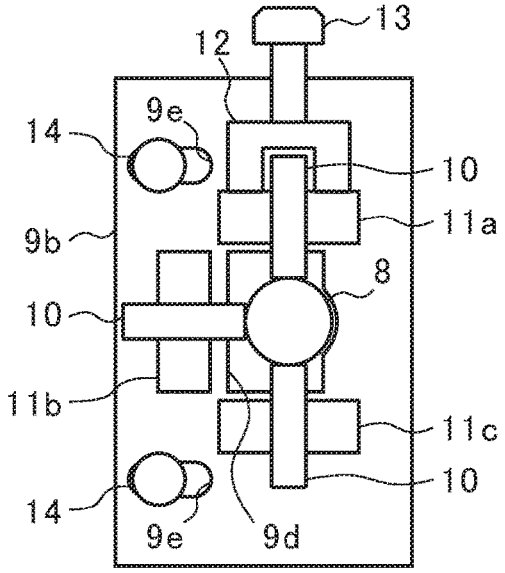
FIGS. 4A and 4B are schematic views of the gripping member of FIG. 3.
Figure 4B:
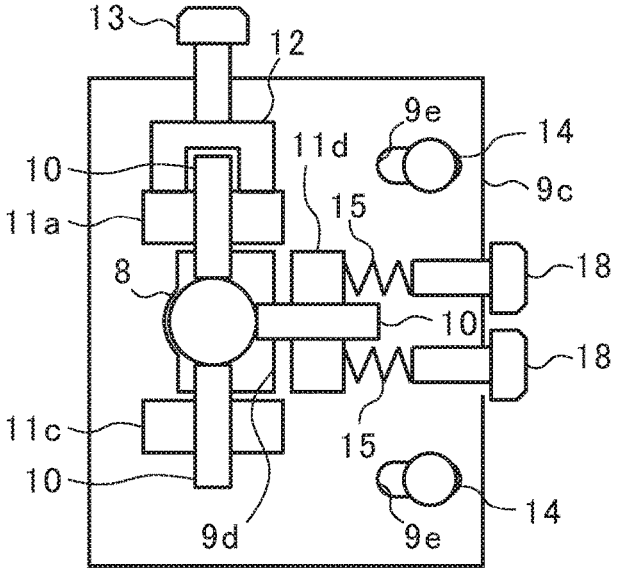

Gripping members 9A and 9B to grip the respective positioning pins 8 are attached to the support frame 7. As illustrated in FIGS. 3, 4A, and 4B, each of the gripping members 9A and 9B includes a fixing portion 9*a* fixed to the support frame 7. The gripping members 9A and 9B also respectively include grip portions 9*b* and 9*c* attached to the respective fixing portions 9*a* in an adjustable manner. The block-shaped fixing portion 9*a* including a rigid body with a certain thickness has the same structure in each of the gripping members 9A and 9B and is fixed to the support frame 7 directly or via a bracket. The fixing portion 9*a* has an upper surface formed with two taps 9*f* (See FIG. 5) used to attach each of the grip portions 9*b* and 9*c*.

The gripping member 9A has the grip portion 9*b* illustrated in FIG. 4A, and the gripping member 9B has the grip portion 9*c* illustrated in FIG. 4B, respectively. The grip portion 9*b* includes three bearings 10 as rotators inside thereof, and the bearings 10 are respectively supported in a rotatable manner by: support shafts 11*a* and 11*b* arranged so that shaft centers of the respective support shafts become perpendicular to each other; and a support shaft 11*c* arranged so that a shaft center of the support shaft 11*c* becomes parallel to the shaft center of the support shaft 11*a*. The support shafts 11*b* and 11*c* are fixed to the grip portion 9*b*, and only the support shaft 11*a* is provided in a manner movable in the vertical direction in FIG. 4A. Biasing force of a biasing member (not illustrated) acts on the support shaft 11*a*, and the support shaft 11*a* is constantly biased upward in FIG. 4A.

A rectangular hole 9*d* exposing a peripheral surface of each of the bearings 10 to one side of the hole 9*d* is provided at a center of the grip portion 9*b*, and a side of the hole 9*d* not exposing each of the bearings 10 is formed in an arc shape so as to have a shape similar to a peripheral surface of the positioning pin 8. The grip portion 9*b* includes a contact piece 12 contacting the support shaft 11*a* inside thereof. The contact piece 12 has a structure movable in the vertical direction in FIG. 4A, and has an upper surface contacting a tip of a positioning screw 13 screwed into the grip portion 9*b*. With this structure, a position of the support shaft 11*a* can be adjusted by the positioning screw 13 in the conveyance direction of the transfer sheet 6. Therefore, the positioning pin 8 can be gripped by the respective bearings 10 supported by at least the support shafts 11*a* and 11*b*. Additionally, an elongated hole 9*e* is formed at the grip portion 9*b*, and the elongated hole 9*e* allows free positioning in the width direction of the transfer sheet 6 when the grip portion 9*b* is fixed to the fixing portion 9*a*. The grip portion 9*b* is fixed to the fixing portion 9*a* by two fixing screws 14.

Figure 5:
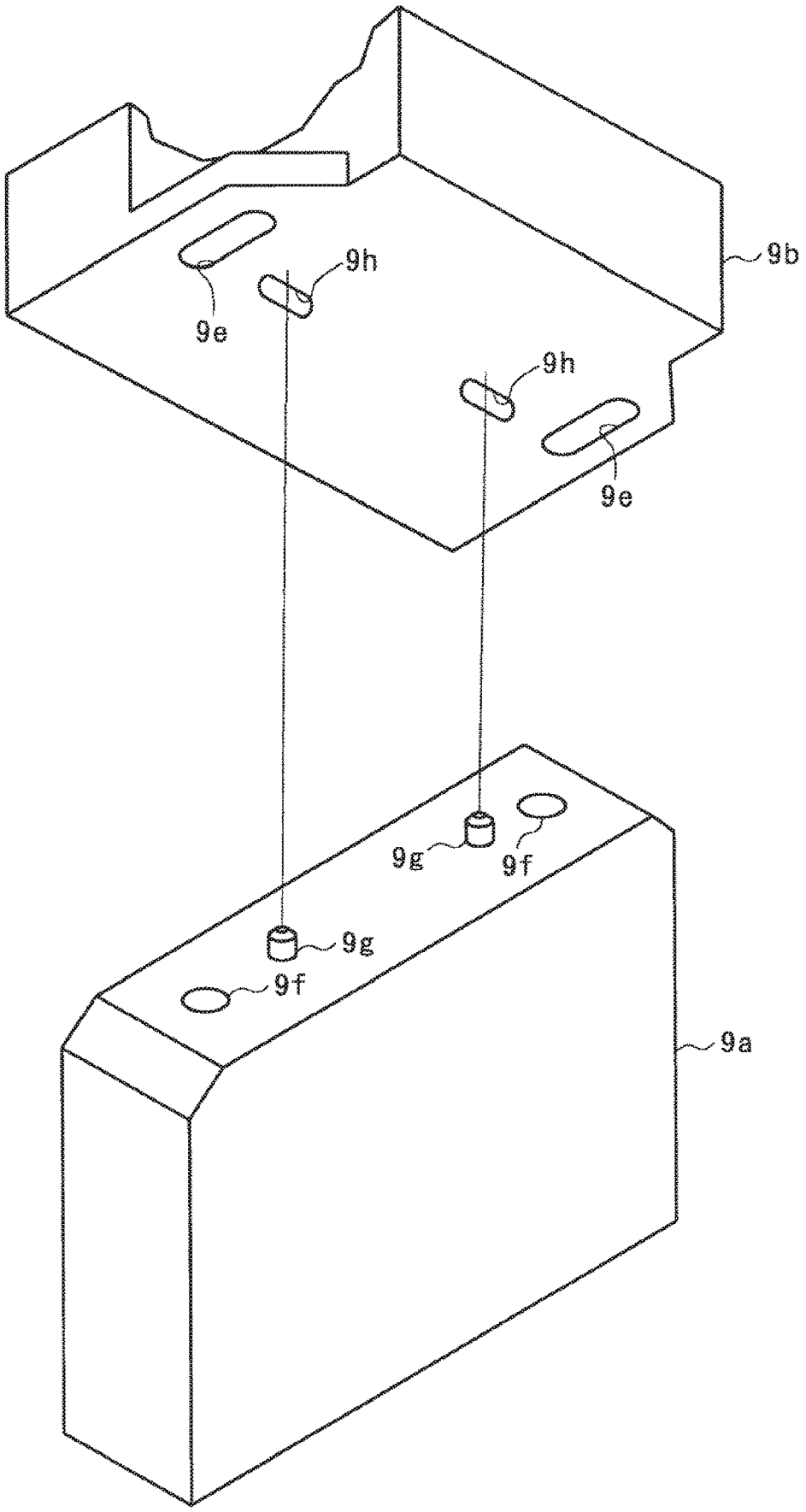
FIG. 5 is a schematic view of the gripping member of FIG. 3.

As illustrated in FIG. 5, on the upper surface formed with the taps 9*f* of the fixing portion 9*a*, two positioning pins 9*g* projecting upward are disposed at inner positions than the respective taps 9*f*. Each positioning pin 9*g* is fixed to the fixing portion 9*a* by screwing, welding, or the like. Additionally, two elongated holes 9*h* are formed on a bottom surface of the grip portion 9*b*. The positioning pins 9*g*, respectively, are insertable into the elongated holes 9*h*. The elongated holes 9*h* allow the grip portion 9*b* to be freely positioned within a range in the conveyance direction of the transfer sheet 6 when the grip portion 9*b* is fixed to the fixing portion 9*a*. Since the positioning pins 9*g* and the elongated holes 9*h* allow the grip portion 9*b* to move in the conveyance direction of the transfer sheet 6, each elongated hole 9*h* is formed wider than the tap 9*f* by the above-described movable range. The fixing screw 14 to be used is sufficiently large relative to the elongated hole 9*e*.

Next, the grip portion 9*c* will be described, but components similar to those in the grip portion 9*b* will be denoted by the same reference signs, and a detailed description thereof will be omitted. The grip portion 9*c* has three bearings 10 inside thereof, and the respective bearings 10 are rotatably supported by: the support shafts 11*a* and 11*c*; and a support shaft 11*d* arranged so that a shaft center of the support shaft 11*d* becomes perpendicular to a shaft center of the support shaft 11*a*. The support shaft 11*d* is provided in a manner movable in a lateral direction in FIG. 4B, and the support shaft 11*d* has a right side contacting one end of a biasing member 15 and is constantly biased rightward in FIG. 4B by biasing force of the biasing member 15. The biasing member 15 has the other end contacting each of tips of two positioning screws 18 screwed into the grip portion 9*c*. With this structure, a position of the support shaft 11*d* can be adjusted in the width direction of the transfer sheet 6 by the respective positioning screws 18. The positioning pins 8 and the respective gripping members 9A and 9B described above constitute a head array fixing device 16.

With the above-described structure, the respective grip portions 9*b* and 9*c* are temporarily fixed to the respective fixing portions 9*a* by the fixing screws 14, and then the head array 3 is moved down to grip the respective positioning pins 8 by the respective gripping members 9A and 9B. At this point, adjustment by the elongated holes 9*e* and 9*h* and adjustment by the positioning screws 13 and 18 are performed so that each of the positioning pins 8 is gripped by the respective bearings 10. Since the head array 3 held in the approach position has the integrally-provided positioning pins 8 gripped by the respective gripping members 9A and 9B, a position of each of the recording heads 2 during the recording operation is determined by the head array fixing device 16, and it is possible to maintain high recording accuracy by performing the recording operation after the adjustment. Additionally, when the head array 3 is held in the approach position even after the head array 3 has retracted from the recording region during the recovery operation or the like, the position of each of the recording heads 2 is determined by the head array fixing device 16. Therefore, high recording accuracy can be maintained in a similar manner.

In the above-described embodiment, the positioning pins 8 each having the columnar shape are used as the gripping target members. However, as far as the positioning pin can be gripped by each of the gripping members 9A and 9B, a positioning pin having any shape can be used as the gripping target member, such as a positioning pin having a prismatic shape or a polygonal columnar shape. Furthermore, the gripping members 9A and 9B each having the bearings 10 which are the three rotators have been exemplified as the gripping members, but a gripping member having four or more bearings 10 may also be used.

Figure 6:
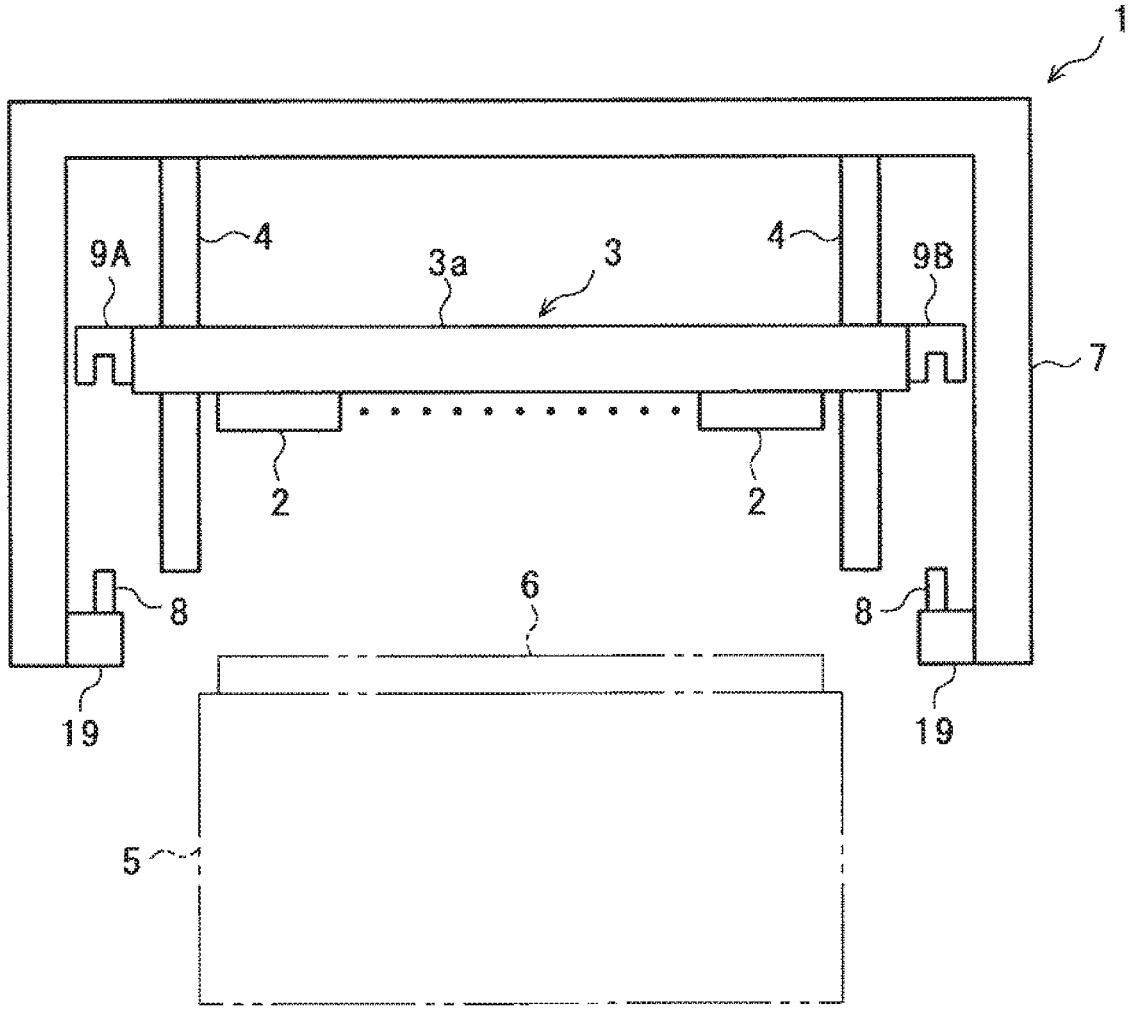
FIG. 6 is a schematic structural diagram of a variation of the liquid discharge device of FIG. 1 during retraction of a head array.
Figure 7:
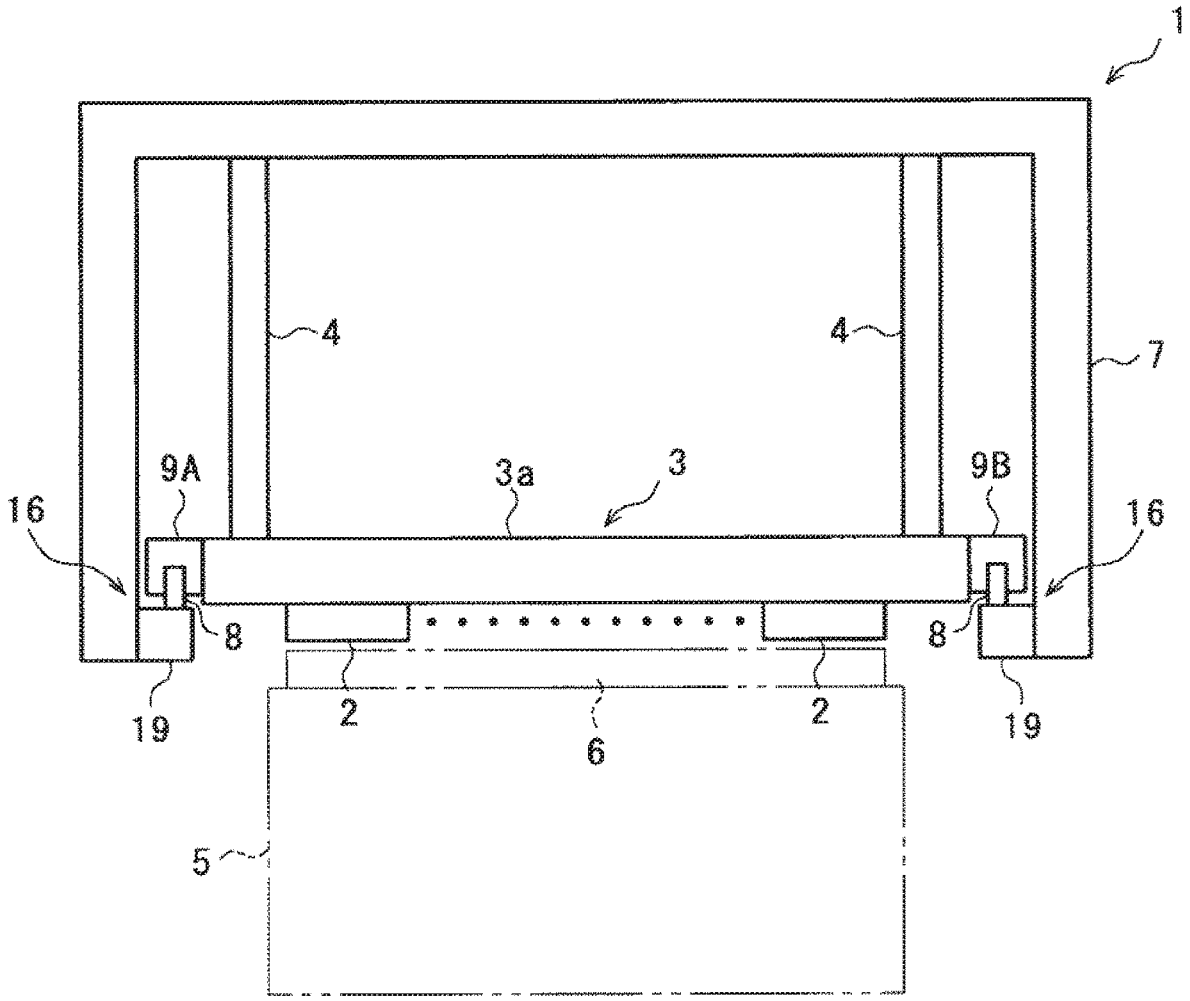
FIG. 7 is a schematic structural diagram of the variation of the liquid discharge device of FIG. 6 during approach of the liquid discharge device to the head array.

Next, a variation of the above-described embodiment is described. The variation illustrated in FIGS. 6 and 7 have substantially the same configuration as the configuration of the above-described embodiment but is different from the above-described embodiment in that the gripping members 9A and 9B as the head array fixing device 16 are attached to the head array body 3*a* and the positioning pins 8 are attached to the support frame 7. FIG. 6 illustrates the variation of the liquid discharge device of FIG. 1 during retraction of the head array; the state of separation. FIG. 7 illustrates the variation of the liquid discharge device during approach of the head array. The positioning pins 8 are fixed to the support frame 7 via the mounting brackets 19, respectively. Such a configuration can obtain the same operational effect as the operational effect of the above-described embodiment. Further, the positioning pins 8 and the gripping members 9A and 9B can be arranged on any side of the upper side and the lower side, thus enhancing the degree of freedom of design.

Next, an ink jet recording apparatus as a liquid discharge apparatus on which the above-described liquid discharge device 1 is mounted will be described with reference to FIG. 8. An inkjet recording apparatus 54 as the liquid discharge apparatus includes, inside an apparatus main body thereof, a head array 3 that is movable in a main-scanning direction and includes respective recording heads 2. Additionally, the apparatus main body houses, inside thereof, the liquid discharge device 1 or the like including the respective recording heads 2, ink tanks 17 to supply ink to the respective recording heads 2, and the like. A sheet feeding cassette 59 (may also be a sheet feeding tray) is detachably attached to a lower portion of the apparatus main body, and the sheet feeding cassette 59 can load, from a front side, transfer sheets 6 corresponding to a large number of recording media. Furthermore, a manual sheet feeding tray 60 that is opened at the time of feeding a transfer sheet 6 is disposed in the apparatus main body. The inkjet recording apparatus 54 takes in the transfer sheet 6 fed from the sheet feeding cassette 59 or the manual sheet feeding tray 60, records a desired image by the liquid discharge device 1, and then ejects the transfer sheet 6 after the image formation to a sheet ejection tray 61 disposed on a rear side.

The head array 3 includes the respective recording heads 2 to discharge ink droplets of respective colors of yellow (Y), cyan (C), magenta (M), and black (Bk). Additionally, the respective ink tanks 17 to supply the ink of the respective colors to the respective recording heads 2 are attached to the head array 3 in a replaceable manner. Each of the ink tanks 17 has an upper side provided with an atmospheric port communicating with the atmosphere, and has a lower side provided with a supply port to supply the ink to each recording head 2. A porous body filled with ink is provided inside each of the ink tanks 17, and the ink to be supplied to each of the recording heads 2 is kept at a slight negative pressure by capillary force of the porous body.

Figure 8:
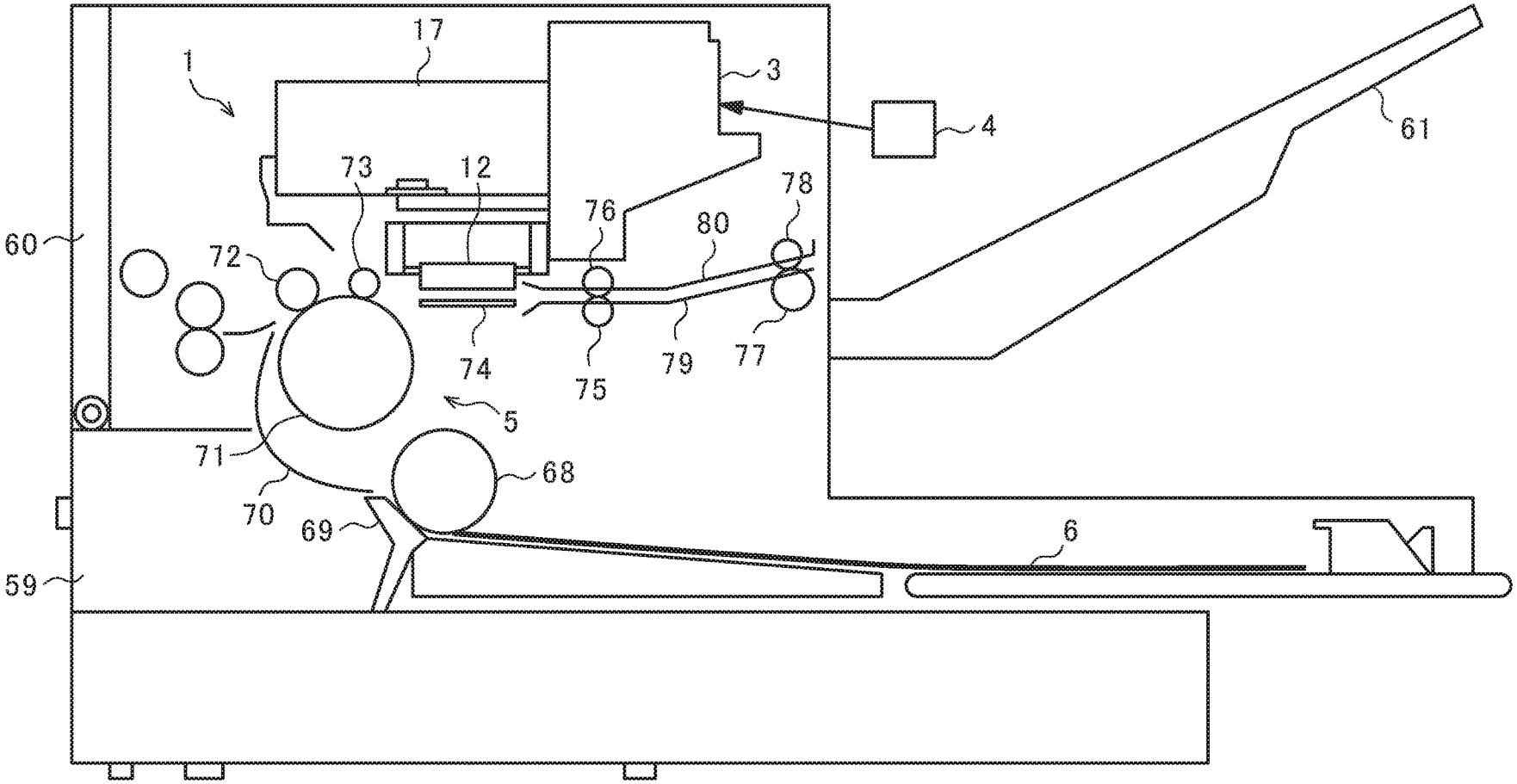
FIG. 8 is a schematic front view of a liquid discharge apparatus on which the liquid discharge device according to an embodiment of the present disclosure can be mounted.

The head array 3 is supported by an above-described moving assembly 4 in a manner movable in the vertical direction in FIG. 8. The head array 3 is selectively held between the retract position illustrated in FIG. 1 and the approach position illustrated in FIG. 2 by drive force from a driving device (not illustrated) included in the moving assembly 4. On the other hand, a sheet feeding roller 68 and a friction pad 69, which separate and feed the transfer sheet 6 from the sheet feeding cassette 59, are disposed in order to convey the transfer sheet 6 set in the sheet feeding cassette 59 to a side below the recording heads 2. Additionally, a guide member 70 to guide the transfer sheet 6 and a conveyance roller 71 to reverse and convey the fed transfer sheet 6 are disposed. Furthermore, a conveyance roller 72 pressed against a peripheral surface of the conveyance roller 71, and a leading end roller 73 regulating a feed angle of the transfer sheet 6 from the conveyance roller 71 are provided. The conveyance roller 71 is rotationally driven by a sub-scanning motor (not illustrated) via a gear train. The conveyance device 5 includes these components.

A print receiving member 74 functioning as a sheet guide member is disposed in order to guide the transfer sheet 6 fed from the conveyance roller 71 at a position below each of the recording heads 2. A conveyance roller 75 and a spur 76, which are rotationally driven to feed the transfer sheet 6 in a sheet ejection direction, are provided on a downstream side in the sheet conveyance direction of the print receiving member 74. Additionally, a sheet ejection roller 77 and a spur 78 to further feed the transfer sheet 6 to the sheet ejection tray 61, and guide members 79 and 80 forming a sheet ejection path are disposed.

In the above-described inkjet recording apparatus 54, each of the recording heads 2 is driven in accordance with an image during recording. Consequently, the ink is discharged onto the transfer sheet 6 being stopped to record one line, the transfer sheet 6 is subsequently conveyed by a predetermined amount, and then a next line is recorded. When a recording termination signal or a signal indicating that a tail end of the transfer sheet 6 has reached the recording region is received, the inkjet recording apparatus 54 terminates the recording operation and ejects the transfer sheet 6.

A recovery device to recover discharge failure of each of the recording heads 2 is disposed at a position out of the recording region. The recovery device includes a suction cap, a pump, and a wiping device. Each of the recording heads 2 is capped with the suction cap during print standby to keep a nozzle in a wet state, thereby preventing occurrence of discharge failure due to ink drying. Furthermore, ink not associated with recording is discharged during the recording operation or the like to keep constant ink viscosity in all of the nozzles and maintain stable discharge state.

In occurrence of discharge failure, the nozzle of each of the recording heads is sealed with the suction cap, and bubbles and the like are sucked together with the ink from the nozzle by using the pump through a waste ink path. Additionally, the ink, dust, or the like adhering to a nozzle surface is removed by a wiping brush. Thus, the state is recovered from the discharge failure, Additionally, the sucked ink is drained to a waste liquid tank provided at a lower portion of the main body, and absorbed and held in an ink absorber provided inside the waste liquid tank.

In the above-described ink jet recording apparatus 54, since the liquid discharge device 1 of the present embodiment is mounted, the position of each of the recording heads 2 during the recording operation is determined by the head array fixing device 16, and high recording accuracy can be maintained. Additionally, when the head array 3 is held in the approach position even after the head array 3 has retracted from the recording region during the recovery operation or the like, the position of each of the recording heads 2 is determined by the head array fixing device 16. Therefore, high recording accuracy can be maintained in a similar manner. Moreover, in the above description, the case where the liquid discharge device 1 discharges the ink has been described, but liquid to which an embodiment of the present disclosure can be applied is not limited to the ink. The liquid discharge device 1 may be applied to a device that discharges patterning liquid resist, for example. Furthermore, the liquid discharge device 1 may also be applied to a device that discharges a gene analysis sample.

In the embodiment and the respective modified examples described above, the example of using the color printer as the liquid discharge apparatus has been described. However, the liquid discharge apparatus is not limited thereto and an embodiment of the present disclosure is also applicable to a printer, a facsimile machine, a multifunction peripheral, and the like. Additionally, in the present embodiment and the modified examples, the structure using the transfer sheet 6 as a recording medium to form an image has been exemplified. However, the transfer sheet 6 is not limited to the recording sheet, and any kind of a transfer sheet can be used including thick paper, a postcard, an envelope, regular paper, thin paper, coated paper (coat paper, art paper, etc.), tracing paper, an overhead projector (OHP) sheet, an OHP film, a resin film, and the like as far as the transfer sheet has a sheet-like shape and an image can be formed thereon.

Some embodiments of the present disclosure have been described above. However, embodiments of the present disclosure are not limited to the above-described embodiments, and various modifications and changes can be made within a range of the gist of the present disclosure recited in the scope of claims.

For example, the above-described embodiments and variation have both the assembly of adjusting the position of the support shaft 11*a* in the conveyance direction of the transfer sheet 6 with the positioning pin 13 and the assembly of adjusting the position of the support shaft 11*d* in the width direction of the transfer sheet 6 with the positioning pins 18. Note that, in some embodiments, any one of the two assemblies may be employed. In the above-described embodiment, the support frame 7 with the gripping members 9A and 9B supports the head array 3. Note that, in some embodiments, the frame having the gripping members 9A and 9B and the frame supporting the head array 3 may be configured as separate bodies. In addition, instead of the support frame 7 as a frame, a support having a block shape or an arm shape may be used.

The effects described in the above-described embodiments of the present disclosure are only examples of effects obtained from the present invention, and the effects provided by the present invention are not limited to those described in the embodiments of the present disclosure.

The invention claimed is:

1. A liquid discharge device comprising:

a head array, a plurality of liquid discharge heads to discharge liquid being arranged on the head array in a width direction, orthogonal to a conveyance direction of a recording medium;

a support body;

a moving assembly to move the head array to an approach position, the head array approaching a recording region of the recording medium at the approach position, and to move the head array to a retract position, the head array being retracted from the recording region at the retract position; and a head array fixing device to fix the head array at the approach position, the head array fixing device including:

a gripping target member, disposed on one of the head array and the support body and extending in a direction in which the head array is configured to approach the recording region of the recording medium or extending in a direction in which the head array is configured to retract from the recording region of the recording medium, and a gripping member including at least two rotatably supported members, disposed on another of the head array and the support body, to grip the gripping target member between the at least two rotatably supported members, to position the gripping target member in the conveyance direction and the width direction, the gripping member being configured to grip the gripping target member at a gripping position, the gripping position being adjustable in at least one of the conveyance direction and the width direction.

2. The liquid discharge device of claim 1, wherein the gripping position is adjustable in each of the conveyance direction and the width direction.

3. The liquid discharge device of claim 2, wherein the support body is a frame supporting the head array.

4. The liquid discharge device of claim 2, wherein the gripping target member includes a pin.

5. The liquid discharge device of claim 2, wherein the gripping member includes at least three rotators to hold the gripping target member.

6. A liquid discharge apparatus comprising the liquid discharge device according to claim 2.

7. The liquid discharge device of claim 2, wherein the gripping target member includes at least two gripping target members, wherein the gripping member includes at least two gripping members, and wherein each of the at least two gripping members include at least two rotatably supported members to hold one of the respective at least two gripping target members.

8. The liquid discharge device of claim 2, wherein the gripping member includes at least two portions, a first portion of the gripping member including at least one elongated hole, and a second portion of the gripping member including at least one pin, the at least one pin being insertable in the at least one elongated hole to allow the pin to be freely positioned, within a range, in the conveyance direction.

9. The liquid discharge device of claim 1, wherein the support body is a frame supporting the head array.

10. The liquid discharge device of claim 1, wherein the gripping target member includes a pin.

11. The liquid discharge device of claim 1, wherein the gripping member includes at least three rotatably supported members to grip the gripping target member.

12. A liquid discharge apparatus comprising the liquid discharge device of claim 1.

13. The liquid discharge device of claim 1, wherein the gripping target member includes at least two gripping target members, wherein the gripping member includes at least two gripping members, and wherein each of the at least two gripping members include at least two rotatably supported members to hold one of the respective at least two gripping target members.

14. The liquid discharge device of claim 1, wherein the gripping member includes at least two portions, a first portion of the gripping member including at least one elongated hole, and a second portion of the gripping member including at least one pin, the at least one pin being insertable in the at least one elongated hole to allow the pin to be freely positioned, within a range, in the conveyance direction.

* * * * *